US007866747B2

(12) United States Patent
Park

(10) Patent No.: US 7,866,747 B2
(45) Date of Patent: Jan. 11, 2011

(54) THEATER SEAT PROVIDING MULTI-DIMENSIONAL SENSE

(75) Inventor: Ki Seok Park, Gangnam-gu (KR)

(73) Assignee: Sigongmedia Co., Ltd., Gangnam-gu (KR)

( * ) Notice: Subject to any disclaimer, the term of this patent is extended or adjusted under 35 U.S.C. 154(b) by 136 days.

(21) Appl. No.: 12/392,232

(22) Filed: Feb. 25, 2009

(65) Prior Publication Data

US 2010/0205867 A1 Aug. 19, 2010

(30) Foreign Application Priority Data

Feb. 17, 2009 (KR) ..... 10-2009-0013065

(51) Int. Cl.
*A47C 7/62* (2006.01)
*A47C 7/72* (2006.01)
*A47C 1/00* (2006.01)

(52) U.S. Cl. ..... 297/217.4; 297/217.3; 297/180.15; 297/344.13; 297/344.17

(58) Field of Classification Search ..... 297/217.1, 297/217.3, 217.4, 217.5, 217.7, 344.1, 344.12, 297/344.13, 180.15, 344.15, 344.17, 181, 297/259.1, 258.1, 260.2
See application file for complete search history.

(56) References Cited

U.S. PATENT DOCUMENTS 3,628,829 A * 12/1971 Heilig ..... 297/217.4
3,923,300 A * 12/1975 Tanus ..... 472/60
3,948,379 A * 4/1976 Warner ..... 194/307
5,143,055 A * 9/1992 Eakin ..... 601/47
5,462,337 A * 10/1995 Yamakami ..... 297/344.13
7,077,465 B1 * 7/2006 Calderon ..... 297/180.15
2010/0090507 A1 * 4/2010 Boulais et al. ..... 297/217.3

* cited by examiner

*Primary Examiner*—Milton Nelson, Jr.
(74) *Attorney, Agent, or Firm*—Brian R. Morrison; Westman, Champlin & Kelly, P.A.

(57) ABSTRACT

A theater seat providing a multi-dimensional sense is provided which allows the audience to directly or indirectly sense various special effects to be absorbed in a movie by stimulating the audience's five senses and presenting environmental conditions substantially similar to the movie. The theater seat providing a multi-dimensional sense includes: a seat having a seat section, a backrest, and a headrest; a motion unit allowing the seat to move vertically, horizontally, and anteroposteriorly; a vibration unit applying local vibrations to a user's hips, femoral region, and back and waist; a speaker transmitting sounds to the user; an actuator stimulating the user's back and waist; an ejection device ejecting a predetermined special effect material to the user; and a controller controlling operations of the motion unit, the vibration unit, the speaker, the actuator, and the ejection device.

7 Claims, 5 Drawing Sheets

THEATER SEAT PROVIDING MULTI-DIMENSIONAL SENSE

BACKGROUND

1. Technical Field

The present invention relates to a theater seat providing a multi-dimensional sense, and more particularly, to a theater seat allowing the audience to directly or indirectly sense various special effects so as to be absorbed in a movie.

2. Related Art

Since a person's both eyes are separated from each other in a horizontal direction by a predetermined distance, both eyes view the same object at different angles. That is, different two-dimensional images are formed on the retinas of both eyes and the two-dimensional images transmitted through the retinas are merged by the brain to reproduce a three-dimensional image having a three-dimensional effect and a perspective effect.

On the other hand, since an image output from a display such as a TV, a monitor, and a theater screen is a two-dimensional image, the image is poor in three-dimensional effect and perspective effect in comparison with a real image (three-dimensional image) and the interest resulting therefrom is limited. In view of this situation, a three-dimensional image system closer to the reality has been actively developed.

The three-dimensional image system can be classified into a stereoscopic 3D system and a real 3D system.

The stereoscopic 3D system is further classified into a stereoscopic type and an autostereoscopic type. Since 1990's, the autostereoscopic image has been actively developed with the development of a flat panel display. In the autostereoscopic type, both eyes are allowed to view different images by forming optical components such as a lenticular lens plate, a film barrier, an LC shutter along with a flat panel display instead of using eyeglasses.

The real 3D image system is further classified into a duration 3D type and a holographic 3D type. In the duration 3D type of the real 3D system, a laser beam is projected to a screen rotating rapidly to form a 3D image. In the holographic 3D type, image information is recorded with a diffraction pattern formed by a beam emitted from an object and a reference beam and the reference beam is projected to the screen again to form a 3D image.

However, the above-mentioned 3D image systems only enable to view a 3D image and are not sufficient to allow the audience to sense realistic actions of a movie. For example, when an earthquake occurs and the earth's crust moves in a movie, the audience can feel only the 3D effect that the earth's crust is cracked but cannot feel the movement of the earthquake. As a result, the interest resulting therefrom is limited.

Accordingly, there is a need for a method of allowing the audience to further interestingly view a movie and to be absorbed in the movie, by reflecting the modern people's mind desiring various distinct experiences to stimulate the audience's five senses or to present environmental conditions substantially similar to the movie unlike the known system mainly depending on the sense of sight.

SUMMARY

An advantage of some aspects of the invention is that it provides a theater seat providing a multi-dimensional sense and allowing the audience to directly or indirectly sense various special effects to be absorbed in a movie by stimulating the audience's five senses and presenting environmental conditions substantially similar to the movie.

According to an aspect of the invention, there is provided a theater seat providing a multi-dimensional sense, including: a seat having a seat section, a backrest, and a headrest; a motion unit allowing the seat to move vertically, horizontally, and anteroposteriorly; a vibration unit applying local vibrations to a user's hips, femoral region, and back and waist; a speaker transmitting sounds to the user; an actuator stimulating the user's back and waist; an ejection device ejecting a predetermined special effect material to the user; and a controller controlling operations of the motion unit, the vibration unit, the speaker, the actuator, and the ejection device.

The theater seat according to the above-mentioned aspect of the invention allows the audience to directly or indirectly sense various special effects to be absorbed in a movie by stimulating the audience's five senses using the motion unit, the vibration unit, the speaker, and the ejection device and presenting environmental conditions substantially similar to the movie.

DESCRIPTION OF EXEMPLARY EMBODIMENTS

Figure 1:
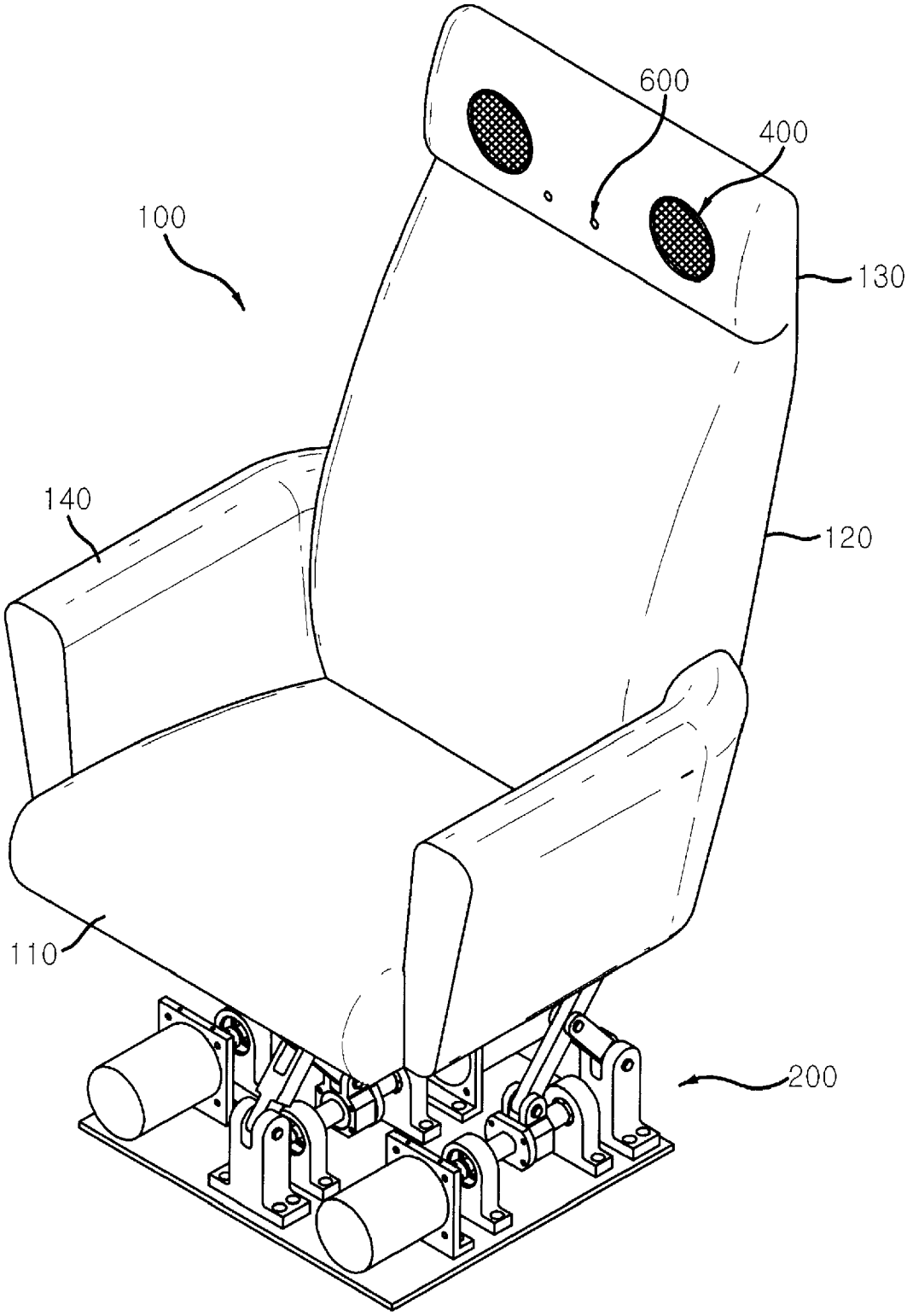
FIG. 1 is a perspective view illustrating a theater seat providing a multi-dimensional sense according to an embodiment of the invention.

Hereinafter, exemplary embodiments of the invention Will be described in detail with reference to the accompanying drawings. When it is determined that detailed description of known techniques associated with the invention make the gist of the invention obscure, the detailed description will be omitted. Like elements are referenced by like reference numerals regardless of the drawing number.

Figure 2:
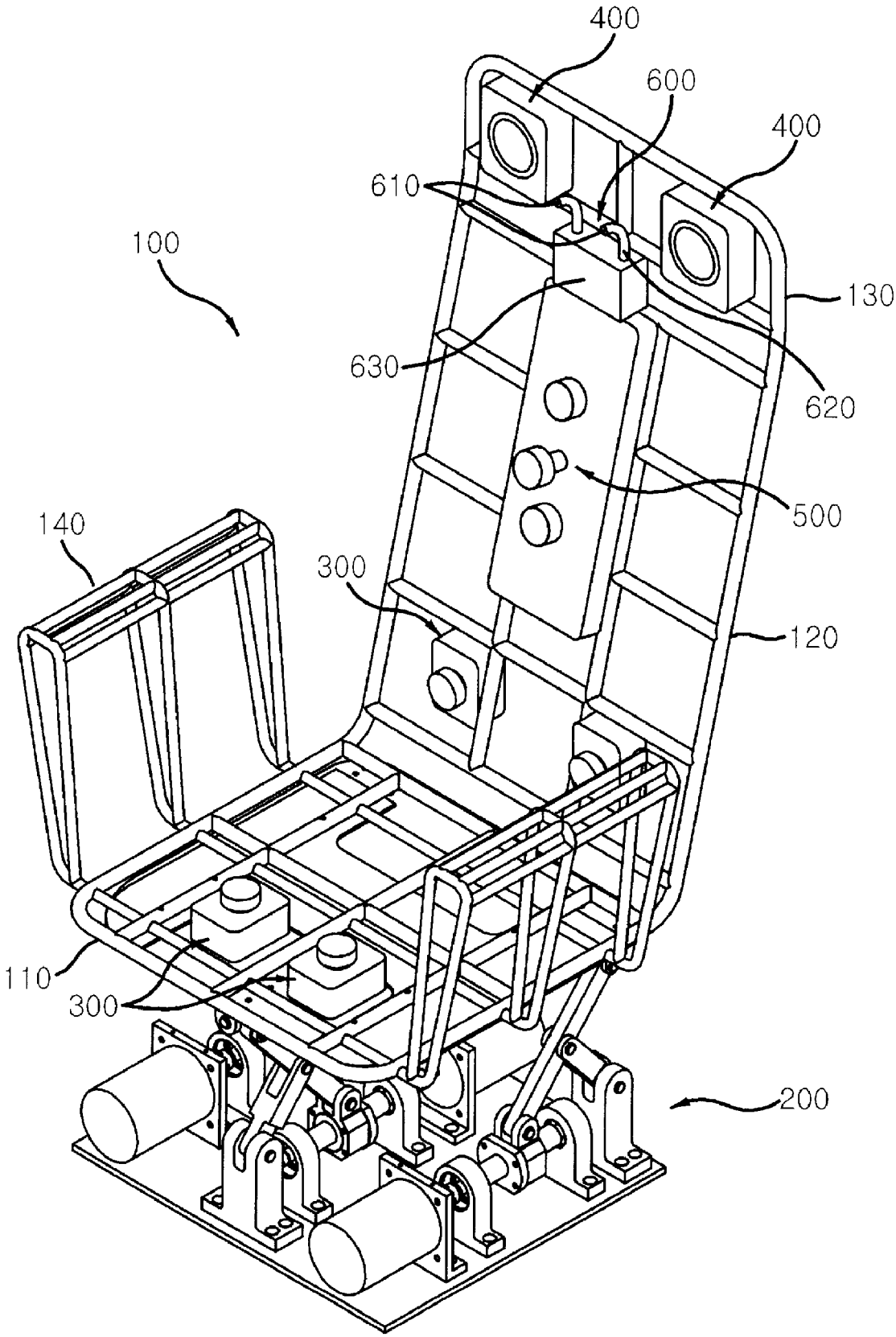
FIG. 2 is a perspective view illustrating an inner structure of the theater seat according to the embodiment of the invention.

FIG. 1 is a perspective view illustrating a theater seat providing a multi-dimensional sense according to an embodiment of the invention and FIG. 2 is a perspective view illustrating an inner structure of the theater seat according to the embodiment of the invention.

As shown in FIGS. 1 and 2, a theater seat providing a multi-dimensional sense according to an embodiment of the invention includes a seat 100 and special effect devices 200 to 600 disposed in the seat 100 to allow the audience to be absorbed in a movie by presenting an environment similar to the movie. The special effect devices 200 to 600 include a motion unit 200, a vibration unit 300, a speaker 400, an actuator 500, and an ejection device 600.

First, the seat 100 includes a seat section 110 supporting a user's femoral region and hips, a backrest 120 supporting the user's back and waist, and a headrest 130 supporting the user's head. Armrests 140 on which the user's arms can be placed are disposed on both sides of the seat section 100. It is preferable that the armrest 140 has a structure for allowing the user to adjust the height.

The motion unit 200 of the special effect devices 200 to 600 is disposed below the seat 100 and allows the seat 100 vertically, anteroposteriorly, and horizontally to prevent the user to environments similar to the movie.

Figure 3:
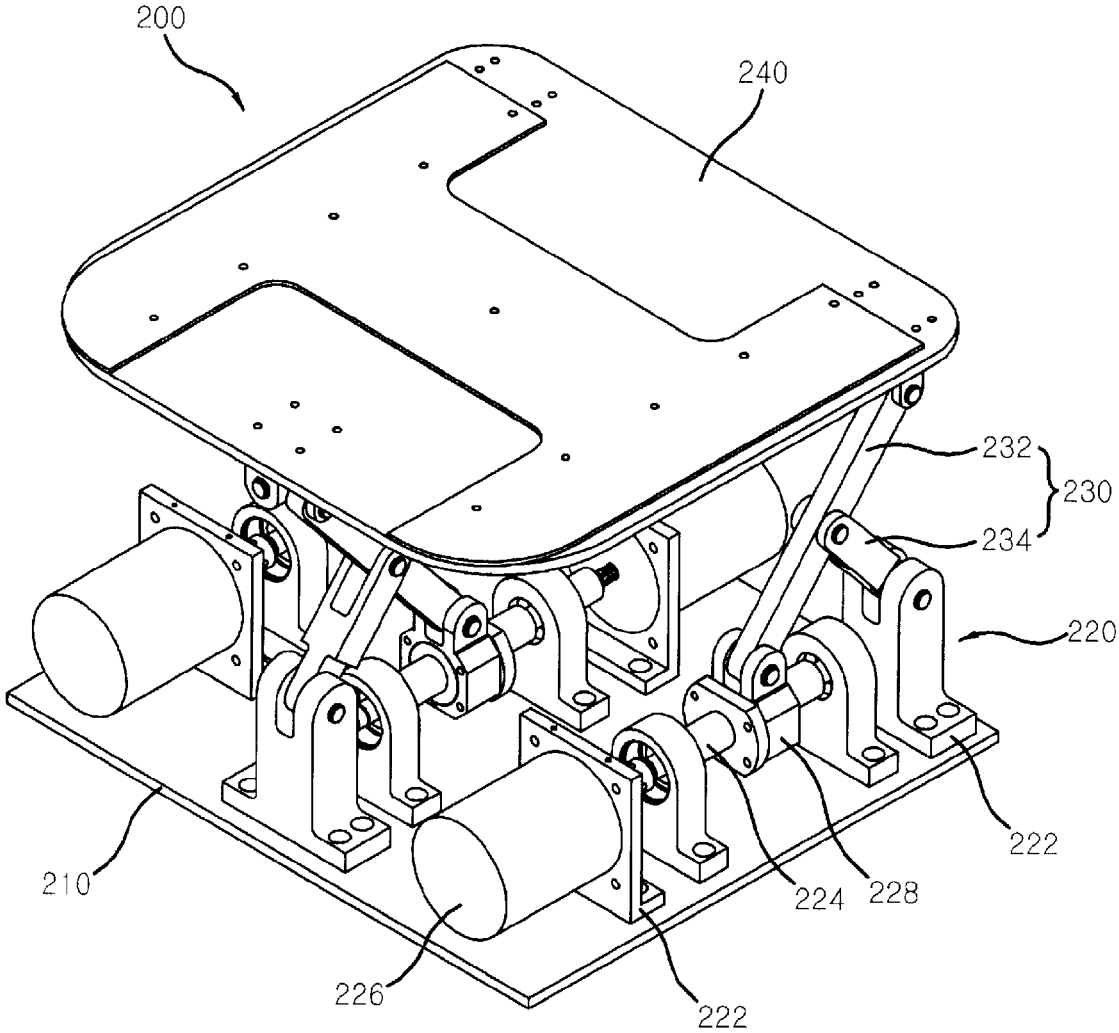
FIGS. 3 and 4 are a perspective view and an exploded perspective view illustrating a motion unit of the theater seat according to the embodiment of the invention, respectively.
Figure 4:
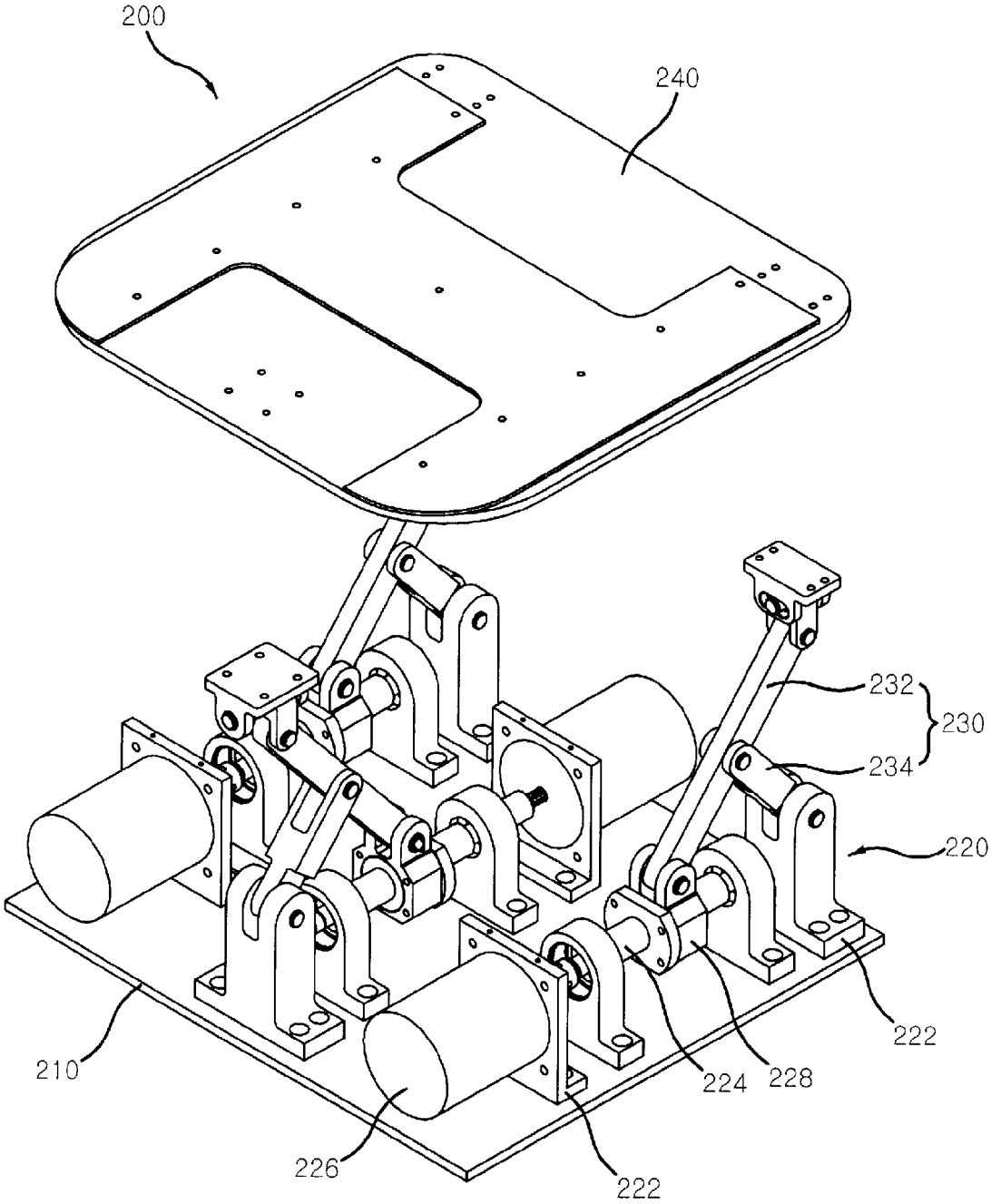

FIGS. 3 and 4 are a perspective view and an exploded perspective view illustrating the motion unit of the theater seat according to the embodiment of the invention.

Referring to FIGS. 3 and 4, the motion unit 200 includes a lower plate 210, three cylindrical joints 220 arranged on the top surface of the lower plate 210, a 4-bar linkage 230 connected to each cylindrical joint 220, and an upper plate 240 disposed above the 4-bar linkages 230 to have the seat section (110 in FIG. 1) disposed thereon.

The lower plate 210 is fixed to the bottom of the theater and serves as means for stably supporting the seat 100 including the motion unit 200. The lower plate 210 is preferably a heavy body having a predetermined area to enhance the stability.

The cylindrical joints 220 arranged on the top surface of the lower plate 210 are joints making a translational motion and a rotational motion and have a 2-degree-of-freedom relative motion enabling relative motion in two different directions.

Each cylindrical joint 220 has a linear guide 224 rotatably disposed between a pair of fixed brackets 222, a motor 226 allowing the linear guide 224 to rotate, and a movable member 228 moving along the linear guide 224 at the time of driving the motor 226.

In this embodiment, three cylindrical joints 220 in total are used for the upper plate 240 to freely move vertically, anteroposteriorly, and horizontally (in an X axis direction, a Y axis direction, and a Z axis direction), and are alternately arranged in the opposite directions. That is, as show in FIG. 3, when a pair of cylindrical joints 220 other than the cylindrical joint 220 located at the center is disposed in the same direction, the upper plate 240 can be made to freely move vertically, anteroposteriorly, and horizontally.

The 4-bar linkage 230 serves as means for allowing the upper plate 240 to move at the time of driving the corresponding cylindrical joint 220 and includes a first link member 232 of which both ends are coupled to the movable member 228 and the upper plate 240 with hinges and a second link member 234 of which both ends are coupled to the fixed bracket 222 and a middle portion of the first link member 232 with hinges.

As shown in FIG. 2, the vibration unit 300 is disposed in the seat portion 110 and the backrest 120 of the seat and serves as means for applying local vibrations to the user's hips, femoral region, and back and waist.

Although not shown in the drawings, the vibration unit 300 includes a vibration plate and a vibration circuit allowing the vibration plate to vibrate. The vibration circuit includes signal oscillating circuitry, signal amplifying circuitry, and signaling circuitry. The vibration unit 300 having the above-mentioned configuration has the same structure as a known vibration device and thus detailed description of the constituent elements of the vibration unit 300 will be omitted.

The speaker 400 serves as means for providing a stereophonic effect to the user. A pair of speakers is built in the headrest 130 of the seat 100 and is disposed at positions adjacent to the user's both ears. In this embodiment, the number of speakers 400 is two, but the invention is not limited to the pair of speakers. The number of speakers can be changed as needed.

The actuator 500 serves as means for stimulating the back and the waist of the user and gives a stimulus greater than that of the vibration unit 300 to the user. For example, in a scene where vehicles collide with each other, the back and the waist of the user is stimulated, whereby the user can feel the impact and can be absorbed in the movie.

The ejection device 600 serves as means for ejecting a special effect material to present an environment similar to the movie and includes ejection nozzles 610 disposed in the vicinity of the user's neck in the headrest 130, transport tubes 620 transporting the special effect material to the ejection nozzles 610, and a compressor 630 connected to the transport tubes 620.

In this way, when the special effect material is ejected to the vicinity of the user's neck, the effect of tension and surprise can be enhanced. In addition, when the temperature of the special effect material is adjusted or a scent-emitting material mixed therewith is ejected, the effect can be further enhanced, of course.

Although not shown in the drawings, the theater seat providing a multi-dimensional sense according to the embodiment of the invention further includes a controller 700 comprehensively controlling the special effect devices 200 to 600, that is, the motion unit 200, the vibration unit 300, the speaker 400, the actuator 500, and the ejection device 600.

Figure 5:
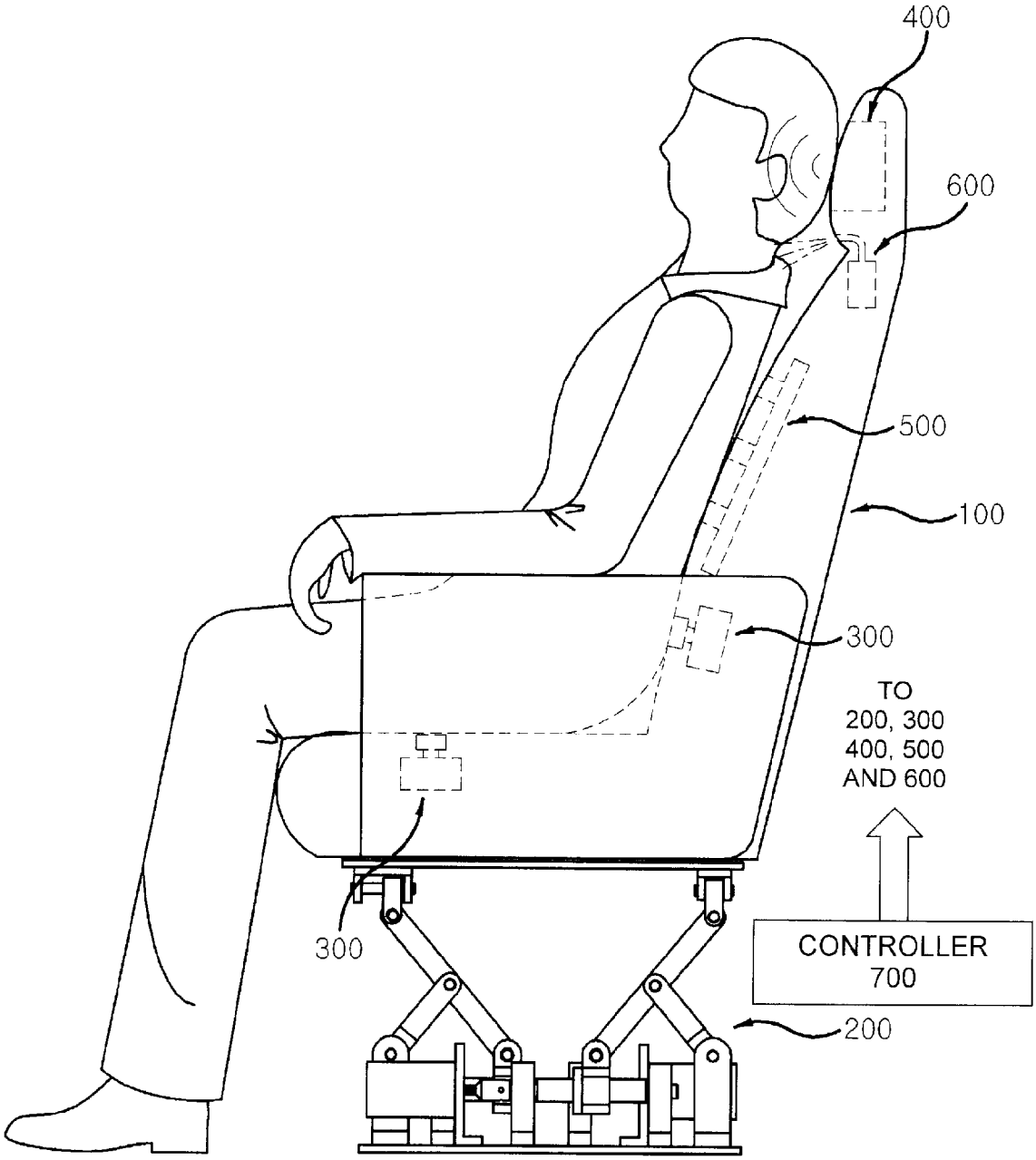
FIG. 5 is a perspective view illustrating a state in use of the theater seat according to the embodiment of the invention.

FIG. 5 is a perspective view illustrating a state in use of the theater seat providing a multi-dimensional sense according to the embodiment of the invention.

As shown in FIG. 5, a user enters a theater room in which the theater seats providing a multi-dimensional sense are arranged, sits on a theater seat, and views a movie.

The theater seat stimulates the user's five senses to present environments similar to the movie, thereby absorbing the user In the movie. For example, in a scene in which an earthquake occurs and the earth's crust moves, the motion unit 200 and the vibration unit 300 are driven to allow the user to feel the situation. In a scene in which vehicles collide with each other, the actuator 500 is used to stimulate the back and the waist of the user, thereby allowing the user to feel the impact of the collision. In a scene in which a fog is heavy or in a scene in which a character eats delicious foods, the ejection device 600 is used to eject a fog or to eject a special effect material including the scent of foods, thereby absorbing the user in the movie.

It will be easily understood by those skilled in the art that the above-mentioned embodiment only exemplifies the technical spirit of the invention and the invention can be modified in various forms without departing from the technical spirit of the invention. Therefore, the scope of the invention depends on only the appended claims and the entire technical spirits equivalent thereto are included in the scope of the invention.

What is claimed is:

1. A theater seat providing a multi-dimensional sense, comprising:

a seat having a seat section, a backrest, and a headrest;

a motion unit allowing the seat to move vertically, horizontally, and anteroposteriorly;

a vibration unit applying local vibrations to a user's hips, femoral region, and back and waist;

a speaker transmitting sounds to the user;

an actuator stimulating the user's back and waist;

an ejection device ejecting a predetermined special effect material to the user; and a controller controlling operations of the motion unit, the vibration unit, the speaker, the actuator, and the ejection device.

2. The theater seat according to claim 1, wherein the motion unit includes a lower plate, three cylindrical joints arranged on the top surface of the lower plate, a 4-bar linkage connected to each of the cylindrical joints, and an upper plate disposed on the 4-bar linkage to have the seat section formed thereon.

3. The theater seat according to claim 2, wherein each cylindrical joint includes a linear guide rotatably coupled between a pair of fixed brackets, a motor rotationally driving the linear guide, and a movable member moving along the linear guide.

4. The theater seat according to claim 3, wherein the 4-bar linkage includes a first link member of which both ends are coupled to the movable member and the upper plate with hinges and a second link member of which both ends are coupled to the fixed bracket and the middle portion of the first link member with hinges.

5. The theater seat according to claim 4, wherein the three cylindrical joints are alternately arranged in the opposite directions.

6. The theater seat according to claim 5, wherein the speaker is built in the headrest of the seat and includes at least a pair of speakers which are separated from each other to be adjacent to both ears of the user.

7. The theater seat according to claim 6, wherein the ejection device includes an ejection nozzle disposed in the headrest of the seat, a transport tube transporting a special effect material to the ejection nozzle, and a compressor connected to the transport tube, and wherein the special effect material is one of gas and liquid and further includes a scent-emitting material.

* * * * *